US006398519B1

(12) United States Patent
Fukai et al.

(10) Patent No.: US 6,398,519 B1
(45) Date of Patent: Jun. 4, 2002

(54) SWASH PLATE COMPRESSOR INCLUDING A CONNECTION MECHANISM BETWEEN A PISTON AND AN INSIDE SURFACE OF A CRANK CHAMBER

(75) Inventors: Isamu Fukai, Fujioka; Keiji Shimizu, Isesaki; Masayuki Kurihara, Sawa-gun, all of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/714,177

(22) Filed: Nov. 17, 2000

(30) Foreign Application Priority Data

Nov. 17, 1999 (JP) ..... 11-326197

(51) Int. Cl.[7] ..... F04B 1/12; F04B 1/26; F01B 3/00

(52) U.S. Cl. ..... 417/269; 417/222.2; 92/12.2; 92/71

(58) Field of Search ..... 417/269, 222.1, 417/222.2; 92/12.2, 71; 91/499

(56) References Cited

U.S. PATENT DOCUMENTS

| | | | | |
|---|---|---|---|---|
| 1,517,386 A | | 12/1924 | Almen | 92/71 |
| 2,335,415 A | | 11/1943 | Holmes | 74/60 |
| 3,010,403 A | | 11/1961 | Zubaty | 417/269 |
| 4,664,604 A | | 5/1987 | Terauchi | 417/222.2 |
| 4,979,877 A | | 12/1990 | Shimizu | 417/222.2 |
| 5,063,829 A | | 11/1991 | Takao et al. | 92/71 |
| 5,140,903 A | | 8/1992 | Terauchi | 92/12.2 |
| 5,269,193 A | | 12/1993 | Rabinow | 74/60 |
| 5,316,446 A | | 5/1994 | Kimura et al. | 417/269 |
| 5,540,559 A | | 7/1996 | Kimura et al. | 417/222.2 |
| 5,644,968 A | | 7/1997 | Kimura et al. | 92/12.2 |
| 5,699,716 A | | 12/1997 | Ota et al. | 92/12.2 |
| 5,762,477 A | * | 6/1998 | Jepsen et al. | 417/269 |
| 5,839,347 A | | 11/1998 | Nomura et al. | 92/12.2 |
| 5,988,041 A | * | 11/1999 | Hiramatsu et al. | 92/71 |
| 6,120,259 A | * | 9/2000 | Miyaji et al. | 417/269 |

FOREIGN PATENT DOCUMENTS

| | | |
|---|---|---|
| EP | 0280479 | 8/1988 |
| FR | 2397545 | 7/1977 |
| JP | 261627 | 12/1990 |

* cited by examiner

*Primary Examiner*—Charles G. Freay
*Assistant Examiner*—Michael K. Gray
(74) *Attorney, Agent, or Firm*—Baker Botts L.L.P.

(57) ABSTRACT

A swash plate compressor includes a cylinder block having positioned therein a plurality of cylinders and a crank chamber. Each of a plurality of pistons has a head portion and a skirt portion. The head portion of the piston is slidably disposed within one of the cylinders. The skirt portion of the piston slidably abuts on an inside surface of the crank chamber, and by its action the pistons are prevented from nutating axes when the pistons are driven in a reciprocating motion within the cylinders upon rotation of the swash plate. The crank chamber has a truncated cone-shape, the inside diameter of which is reduced between a top dead center and a bottom dead center of the piston. The structure for the swash plate compressor according to this invention reduces vibration and noise caused by the nutation of the pistons.

2 Claims, 2 Drawing Sheets

SWASH PLATE COMPRESSOR INCLUDING A CONNECTION MECHANISM BETWEEN A PISTON AND AN INSIDE SURFACE OF A CRANK CHAMBER

BACKGROUND OF THE INVENTION

1. Field of the Invention

The present invention relates to a swash plate compressor with a crank chamber adapted for use in a vehicle air-conditioner. In particular, the invention relates to a swash plate compressor with a crank chamber, which contains the movement of pistons during each suction and discharge stroke, while suppressing noisy vibration of the pistons.

2. Description of Related Art

Swash plate compressors are known in the art. The structure of a known swash plate compressor includes a closed, cylinder casing assembly bracketed by a front housing and a cylinder head, and such compressors are provided with a cylinder block at a cylinder head side and a hollow portion, such as a crank chamber. The cylinder block has a plurality of annularly arranged cylinders within which pistons slide. A drive shaft is rotatably supported by the central portion of the cylinder block and the front housing. A swash plate is connected to the drive shaft at predetermined angle. Pistons, which are operably connected to the swash plate by means of shoes, reciprocate within cylinders. Each piston has a head portion at one end and a skirt portion at another end.

In operation, the drive shaft is rotated by the engine of a vehicle through a pulley arrangement. The rotation of the drive shaft is transferred to the swash plate, so that, with respect to the rotation of the drive shaft, the inclined surface of the swash plate moves axially to the right and left. As pistons reciprocate, refrigerant gas, which is introduced into a suction chamber from a fluid inlet port, is drawn into each cylinder and compressed. Pistons are prevented from rotating because they abut an inside surface of the crank chamber thereof at the skirt portion. The compressed refrigerant gas is discharged to the discharge chamber from each cylinder through a discharge port and therefrom into an external fluid circuit, for example, a cooling circuit, through the fluid outlet port.

There is a very small clearance in a sliding surface between the head portion of the piston and the cylinder, within which a lubricating oil film is retained. When each of the pistons approaches a bottom dead center and the length of the sliding surface between the head portion of that piston and the cylinder becomes small or reaches a minimum, the restriction of the free movement of that piston caused by the cylinder, eases. There also is a very small clearance in the sliding surface between an outside surface of the skirt portion of the piston and an inside surface of the crank chamber. When the restriction of the free movement of the piston eases, the skirt portion of the piston is drawn in the direction of the rotation of the swash plate. Therefore, the piston tends to slant in the direction of the rotation of the swash plate and against the sliding surface between the head portion of the piston and the cylinder. Consequently, the pistons may nutate, and as a result, the pistons may vibrate, and compressor noise may increase.

SUMMARY OF THE INVENTION

An object of the present invention is to eliminate or reduce the above-mentioned defects encountered in known swash plate compressors having a crank chamber and pistons.

Another object of the present invention is to provide a swash plate compressor adapted to be used for forming a quiet, vehicle air-conditioning system.

In an embodiment of the present invention, a swash plate compressor comprises a cylinder block having a plurality of cylinders positioned therein, a crank chamber, a suction chamber, and a discharge chamber. Each of the plurality of pistons has a head portion and a skirt portion. The head portion of the piston is slidably disposed within one of the cylinders. The skirt portion of the piston slidably abuts on an inside surface of the crank chamber that prevents the pistons from nutating. For example, the reciprocating motion of a skirt portion of each piston in a direction tangential to the circumference of the swash plate or the rotation of the pistons about their axes, or both, is prevented. A drive shaft is rotatably supported in the cylinder block. A swash plate is disposed in the crank chamber and is tiltably connected to the drive shaft. A bearing couples the swash plate to each of the pistons, so that the pistons are driven in a reciprocating motion within the cylinders upon rotation of the swash plate. The crank chamber has a truncated cone-shape having an oblique angle, such that an inside diameter of the crank chamber decreases between a top dead center and a bottom dead center of the piston.

Other objects, features, and advantages will be apparent to persons of ordinary skill in the art from the following description of the invention with reference to the accompanying drawings.

BRIEF DESCRIPTION OF THE DRAWINGS

The present invention may be more readily understood with reference to the following drawings, in which.

DETAILED DESCRIPTION OF PREFERRED EMBODIMENTS

Figure 1:
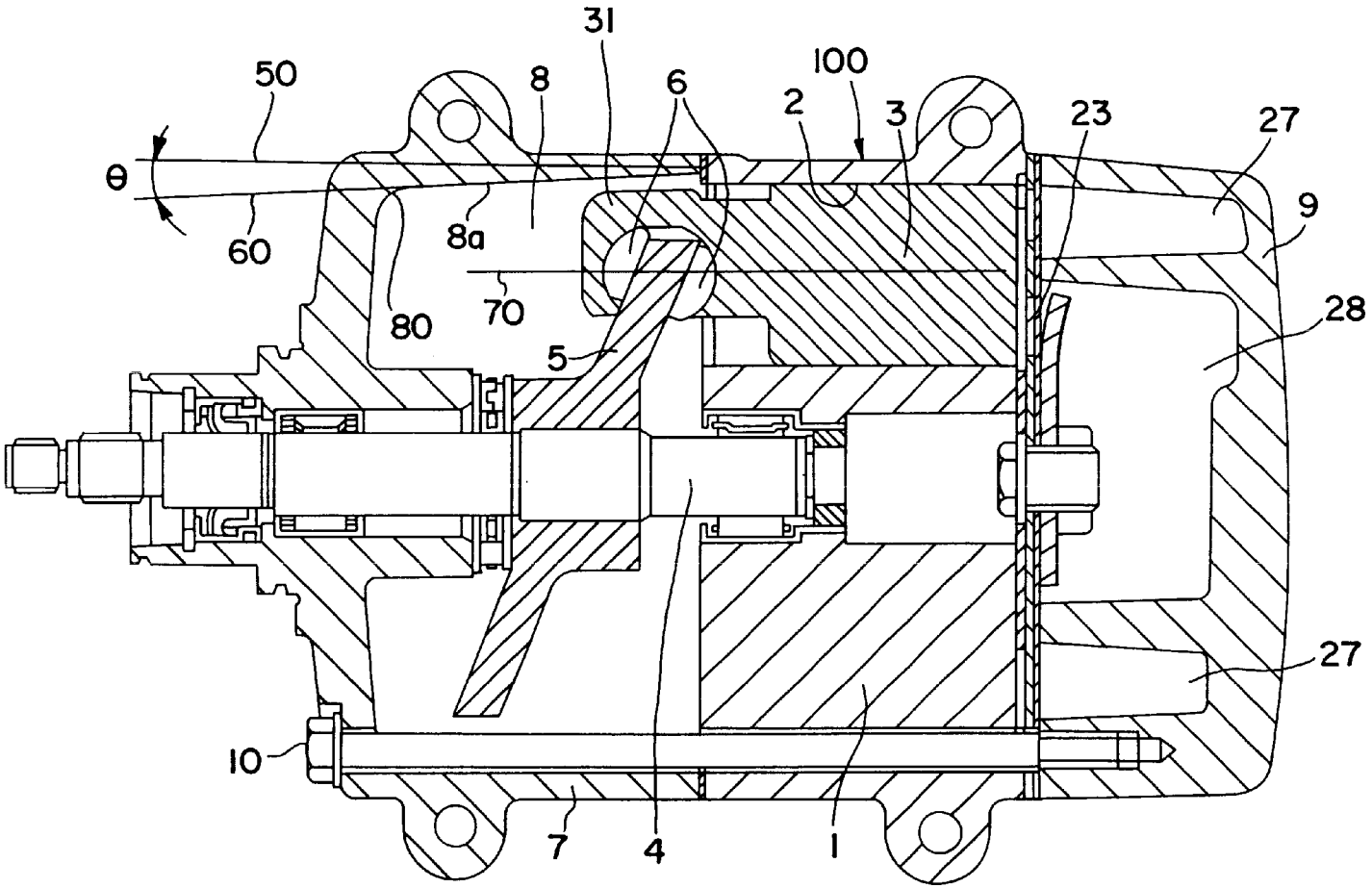
FIG. 1 is a longitudinal, cross-sectional view of a swash plate compressor, according to the present invention.

Referring to FIG. 1, a longitudinal, cross-sectional view of a swash plate compressor 100 according to the present invention is shown. Compressor 100 includes cup-shaped front housing 7, cylinder head 9, cylinder block 1, and a plurality of single head pistons 3. Further, compressor 100 includes drive shaft 4, swash plate 5, and a plurality of hemispherical shoes 6. Front housing 7 together with cylinder block 1 are secured to cylinder head 9 by a plurality of bolts 10. A plurality of cylinders 2 are formed in cylinder block 1. Pistons 3 are accommodated in cylinders 2 and are independently and reciprocally movable therein. Drive shaft 4 is rotatably supported by a central portion of cylinder block 1 and front housing 7. Swash plate 5 is connected at a predetermined angle to drive shaft 4 and is reciprocally slidable together with hemispherical shoes 6 parallel to the axis of drive shaft 4. Hemispherical shoes 6 are disposed between each sliding surface of swash plate 5 and an inner surface of piston skirt portions 31 of pistons 3, so that pistons 3 may slide along the side surface of swash plate 5. Thus, each piston 3 is coupled to swash plate 5 through hemispherical shoes 6.

Drive shaft 4, swash plate 5, and piston skirt portions 31 of pistons 3 are located in crank chamber 8, which is formed within front housing 7. Crank chamber 8 has a truncated cone-shape, the inside diameter of which is reduced from the top dead center to the bottom dead center of piston 3, i.e., the inside diameter decreases as front housing 7 extends away from cylinder head 9, by an oblique angle θ. Specifically, oblique angle θ is formed between a first line 50 which is parallel to an axis 70 of piston 3 and a second line 60 which extends along an inside surface 8*a* of crank chamber 8 and intersects a front corner 80 of crank chamber 8. Moreover, the inside diameter of crank chamber 8 is reduced from the top dead center to the bottom dead center of piston 3 because at least a portion of inside surface 8*a* of crank chamber 8 is tapered, e.g., linearly tapered. When at least a portion of inside surface 8*a* of crank chamber 8 is tapered, skirt portion 31 of piston 3 may slidably abut the tapered portion of inside surface 8*a* when piston 3 moves from the top dead center position to the bottom dead center position, which may prevent piston 3 from rotating.

Figure 2:
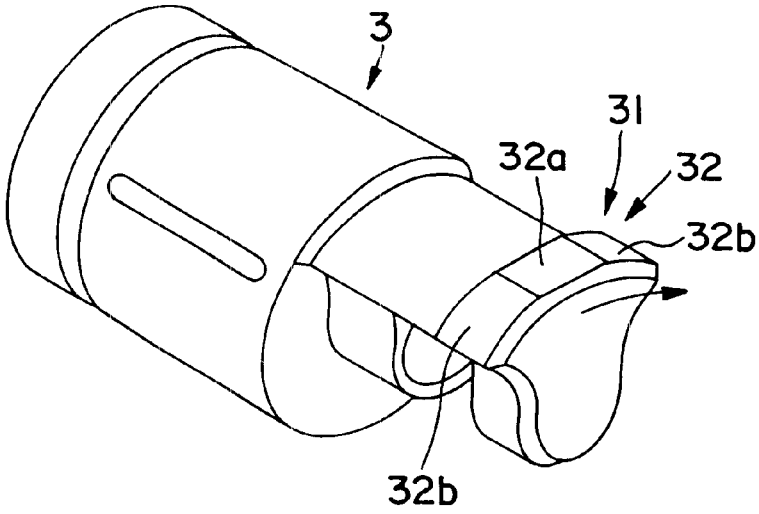
FIG. 2 is an oblique, perspective view of a piston according to the present invention.
Figure 3:
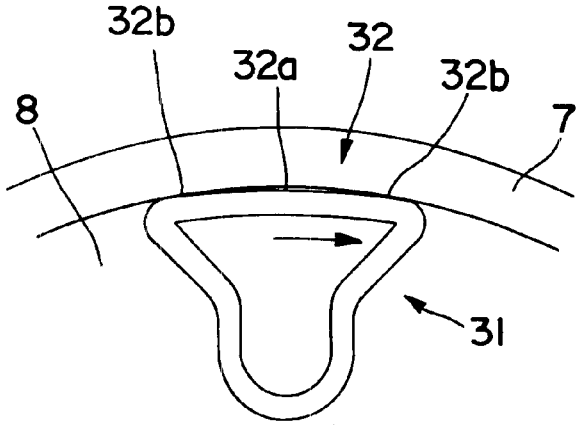
FIG. 3 is cross-sectional view showing an abutting connection between a piston skirt portion and an inside surface of a crank chamber.

Referring to FIG. 2, piston skirt portion 31 of piston 3 has outside surface 32, which comprises a flat surface 32*a* and a pair of circular arc surfaces 32*b*. Flat surface 32*a* is disposed between the pair of circular arc surfaces 32*b*. As shown in FIG. 3, circular arc surfaces 32*b* of outside surface 32 abut on the inside surface of crank chamber 8.

In operation, when a driving force is transferred to the compressor from an external driving source (e.g., an engine of a vehicle) via a pulley arrangement (not shown), drive shaft 4 is rotated. The rotation of drive shaft 4 is transferred to swash plate 5, so that, with respect to the rotation of drive shaft 4, the inclined surface of swash plate 5 moves axially to the right and the left. Pistons 3, which are operatively connected to swash plate 5 by means of hemispherical shoes 6, reciprocate within cylinders 2. As pistons 3 reciprocate, refrigerant gas, which is introduced into suction chamber 27 from a fluid inlet port (not shown), is drawn into each cylinder 2 and compressed. The compressed refrigerant gas is discharged into discharge chamber 28 from each cylinder 2 through discharge ports 23 and therefrom into a fluid circuit, for example, a cooling circuit, through a fluid outlet port (not shown). As circular arc surfaces 32*b* of piston skirt portion 31 abut on the inside surface of crank chamber 8, pistons 3 are prevented from nutating, and each of a head portion of pistons 3 reciprocates smoothly within each of cylinder 2.

Crank chamber 8 has a truncated cone-shape, the inside diameter of which is reduced between the top dead center and the bottom dead center of piston 3. Therefore, when piston 3 moves toward the bottom dead center, circular arc surfaces 32*b* of piston skirt portion 31 are pressed against the inside surface of crank chamber 8, and the force between the sliding surfaces of both circular arc surface 32*b* and the inside surface of crank chamber 8 is increased. As a result, when piston 3 moves toward the bottom dead center, the nutation of piston 3, whose direction is shown by the arrows of FIGS. 2 and 3, may be reduced by the friction generated in the sliding surfaces between circular arc surface 32*b* and the inside surface of crank chamber 8. Therefore, vibration and noise caused by the nutation of pistons 3 may be reduced or eliminated.

If the oblique angle θ of truncated cone-shaped, crank chamber 8 is too large, the smooth reciprocating motion of pistons 3 may be hindered. On the other hand, if the oblique angle θ of truncated cone-shaped, crank chamber 8 is too small, the nutation generated vibration and noise of pistons 3 may not be reduced. If the numerical value of the oblique angle θ of truncated cone-shaped, crank chamber 8 is in a range of about $0.1° \leqq \theta \leqq$ about 1.0°, the nutation generated vibration and noise of pistons 3 may be reduced or eliminated without hindering the smooth reciprocating motion of pistons 3.

As described above, in the embodiments of the present invention of a swash plate compressor, crank chamber 8 has truncated cone-shape, the inside diameter of which is reduced between the top dead center and the bottom dead center of piston 3. Therefore, when piston 3 moves toward the bottom dead center, circular arc surfaces 32*b* of piston skirt portion 31 are pressed against the inside surface of crank chamber 8, and the friction between the sliding surfaces of both circular arc surface 32*b* and the inside surface of crank chamber 8 increases. As a result, when piston 3 moves toward the bottom dead center, the nutation generated vibration and noise of piston 3 may be reduced by the friction generated in the sliding surfaces between circular arc surface 32*b* and the inside surface of crank chamber 8. Therefore, vibration and noise caused by the nutation of pistons 3 may be reduced or eliminated.

Further, if the oblique angle θ of truncated cone-shaped, crank chamber 8 is in a range of about $0.1 \leqq \theta \leqq$ about 1.0°, the nutation generated vibration and noise of pistons 3 may be reduced or eliminated, without hindering the smooth reciprocating motion of pistons 3.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A swash plate compressor comprising:

a compressor housing including a crank chamber, a suction chamber, a discharge chamber, and a cylinder block;

a plurality of cylinders positioned in said cylinder block;

a plurality of pistons, each of said pistons having a head portion and a skirt portion, and each of said head portions is slidably disposed within one of said cylinders;

a drive shaft rotatably supported in said cylinder block;

a swash plate disposed in said crank chamber and tiltably connected to said drive shaft; and a pair of shoes coupling said swash plate to each of said pistons, so that said pistons are driven in a reciprocating motion within said cylinders upon rotation of said swash plate, wherein said crank chamber has a truncated cone-shape having an oblique angle formed between a first line which is parallel to an axis of said piston and a second line which extends along an inside surface of said crank chamber and intersects a front corner of said crank chamber, such that at least a portion of said inside surface of said crank chamber is linearly tapered, wherein said skirt portion of said piston is adapted to slidably abut said linearly tapered portion of said inside surface, thereby preventing said piston from rotating.

2. The swash plate compressor of claim 1, wherein said oblique angle is between about 0.1° and about 1.0°.

* * * * *